US006003178A

United States Patent [19]

Montoni

[11] Patent Number: 6,003,178

[45] Date of Patent: Dec. 21, 1999

[54] ANATOMIC MATTRESS

[76] Inventor: Carlos Alberto Montoni, Alameda dos Limoeiros, n° 176, Arujá Country Club, Arujá, São Paulo, Brazil, 07400-000

[21] Appl. No.: 08/726,085

[22] Filed: Oct. 4, 1996

[51] Int. Cl.[6] ..... A47C 23/06

[52] U.S. Cl. ..... 5/690; 5/701; 5/728; 5/241

[58] Field of Search ..... 5/191, 241, 239, 5/243, 245, 701, 719, 728, 934, 935, 936, 900.5, 253, 258, 690

[56] References Cited

U.S. PATENT DOCUMENTS

| | | | |
|---|---|---|---|
| 3,031,690 | 5/1962 | Ramsay | 5/253 X |
| 3,126,554 | 3/1964 | Jamapol | 5/723 X |
| 3,160,894 | 12/1964 | Frey | 5/243 |
| 4,956,834 | 9/1990 | Hwang | 5/258 X |

FOREIGN PATENT DOCUMENTS

| | | | |
|---|---|---|---|
| 166275 | 7/1950 | Austria | 5/243 |
| 2623068 | 5/1989 | France | 5/448 |
| 67765 | 4/1892 | Germany | 5/258 |

*Primary Examiner*—Michael F. Trettel
*Attorney, Agent, or Firm*—Michael J. Striker

[57] ABSTRACT

An anatomic mattress has an external structure, and an internal structure located interiorly of the external structure, the internal structure including an upper part and a lower part, the lower part being formed as a continuous lower plate while the upper part being formed by a plurality of individual upper plates connected with the lower plate, by a plurality of projections located between the lower plate and each of the upper plates.

10 Claims, 3 Drawing Sheets

ANATOMIC MATTRESS

BACKGROUND OF THE INVENTION

The present invention relates generally to anatomic mattresses which, due to their technical and construction characteristics, provide advantageous features when compared with other mattresses.

It is believed that currently existing mattresses do not provide a perfect rest to a user, since in many instances the user's body is not accommodated on a soft and comfortable surface which at the same time provides an equilibrium for the spine in a perfect manner. The foam mattresses are known, which are composed as a whole of a foam layer without an internal structure. However, if the foam is of a high density, the mattress becomes hard while if the foam is a low density, it becomes too soft and deepens too much where the body is heavy. There are spring mattresses with advantages of a high flexibility, but presenting the same problems of the foam mattresses, since they deepen too much where the body is more heavy. Known orthopaedic mattresses offer a partial solution of the excessive deepening problem at the portions where the body is more heavy by introducing a core formed as a rigid structure. However, these mattresses, depending on the weight of the user or even of his/her position in the bed, present problem of excessive rigidity, which can result in a bad blood circulation, pains at kidneys or junctions, when laying down on one side.

SUMMARY OF THE INVENTION

Accordingly, it is an object of the present invention to provide an anatomic mattress which avoids the disadvantages of the prior art.

In keeping with these objects and with others which will become apparent hereinafter, one feature of the present invention resides, briefly stated, in an anatomic mattress which has an external structure, and an internal structure, wherein the internal structure has an upper part composed of plurality of plates arranged near one another in a horizontal direction, a lower part located under the upper part, and a plurality of projections provided between the lower part and each of the plates of the upper part.

When the anatomic mattress is designed in accordance with the present invention, it eliminates the disadvantages of the prior art.

In accordance with another feature of present invention, the projections can be provided on each of the plates of the upper parts, while the lower part can be provided with a plurality of grooves in which the projections extend with interposition of flexible springs.

In accordance with still another feature of present invention, the lower part is formed as a unitary plate and is provided at its lower surface with an upholstering/padding layer, while the upper part is provided on its upper surface with another layer, the layers forming the external structure of the mattress.

Also, the corresponding layers can be provided on the sides of the internal structure, and the whole mattress can be covered with an adequate fabric.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
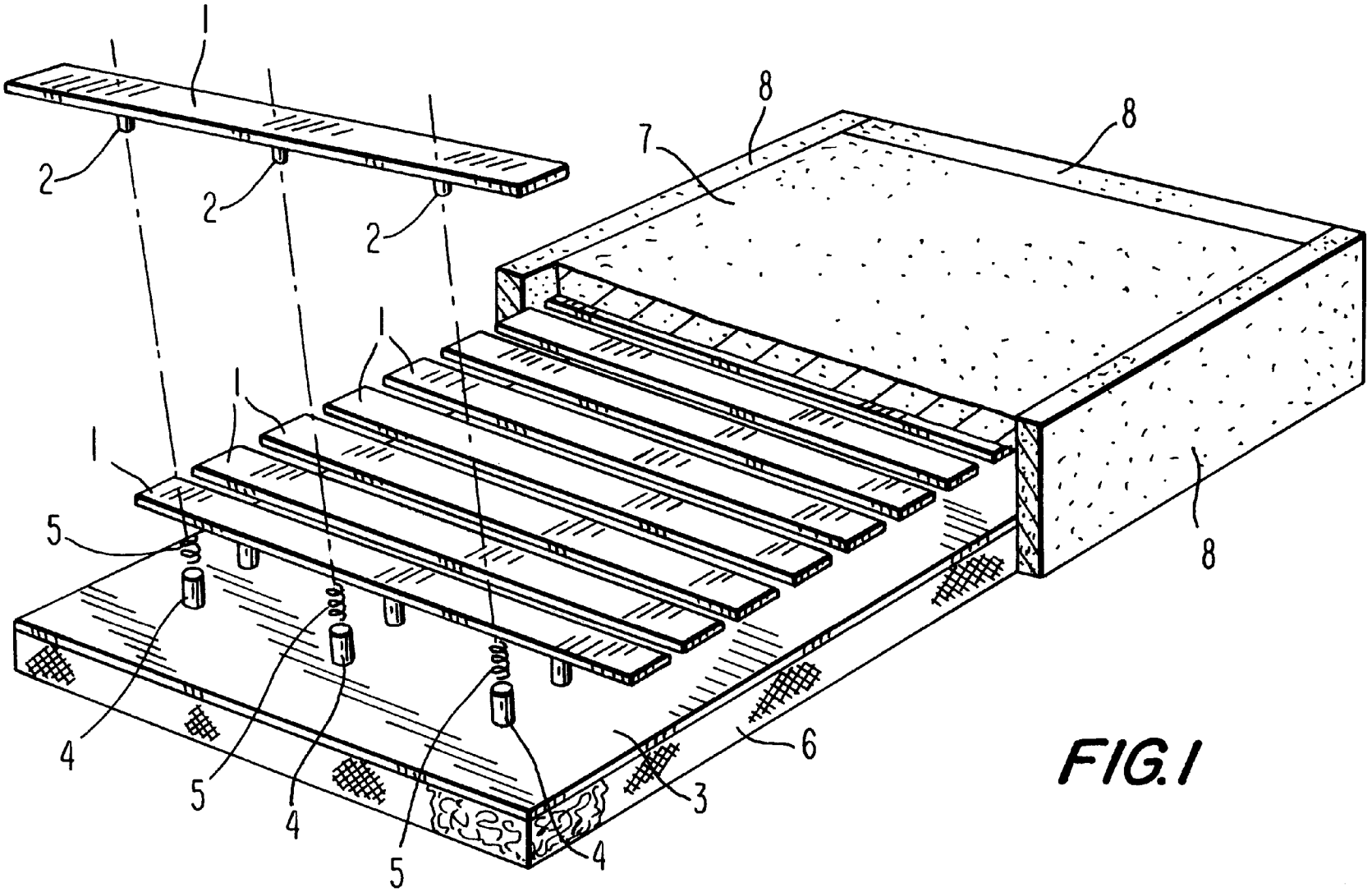
FIG. 1 is a perspective view showing an anatomic mattress in accordance with the present invention, partially sectioned.
Figure 2:
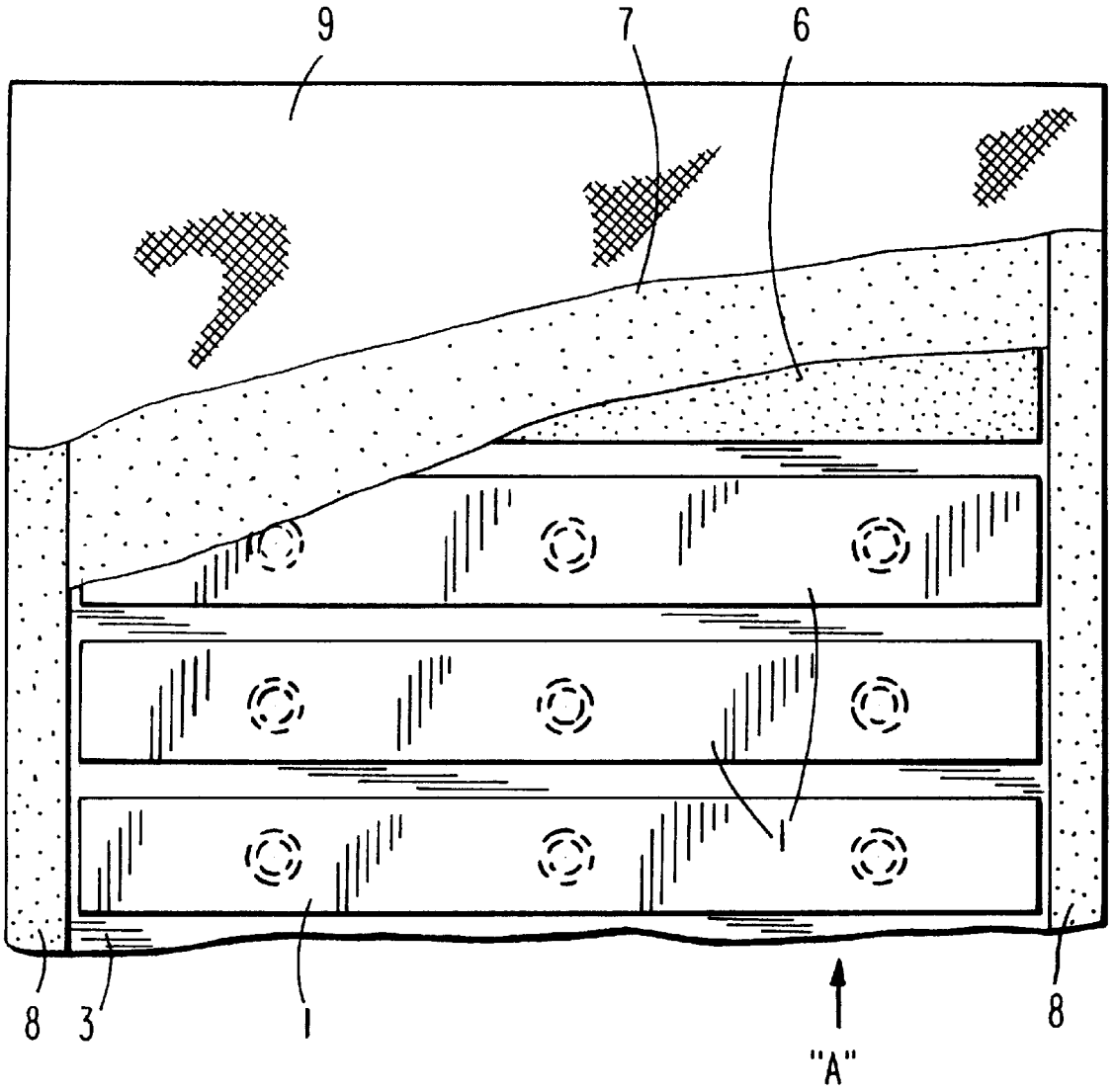
FIG. 2 is a plane view of the anatomic mattress of FIG. 1, also partially sectioned.
Figure 3:
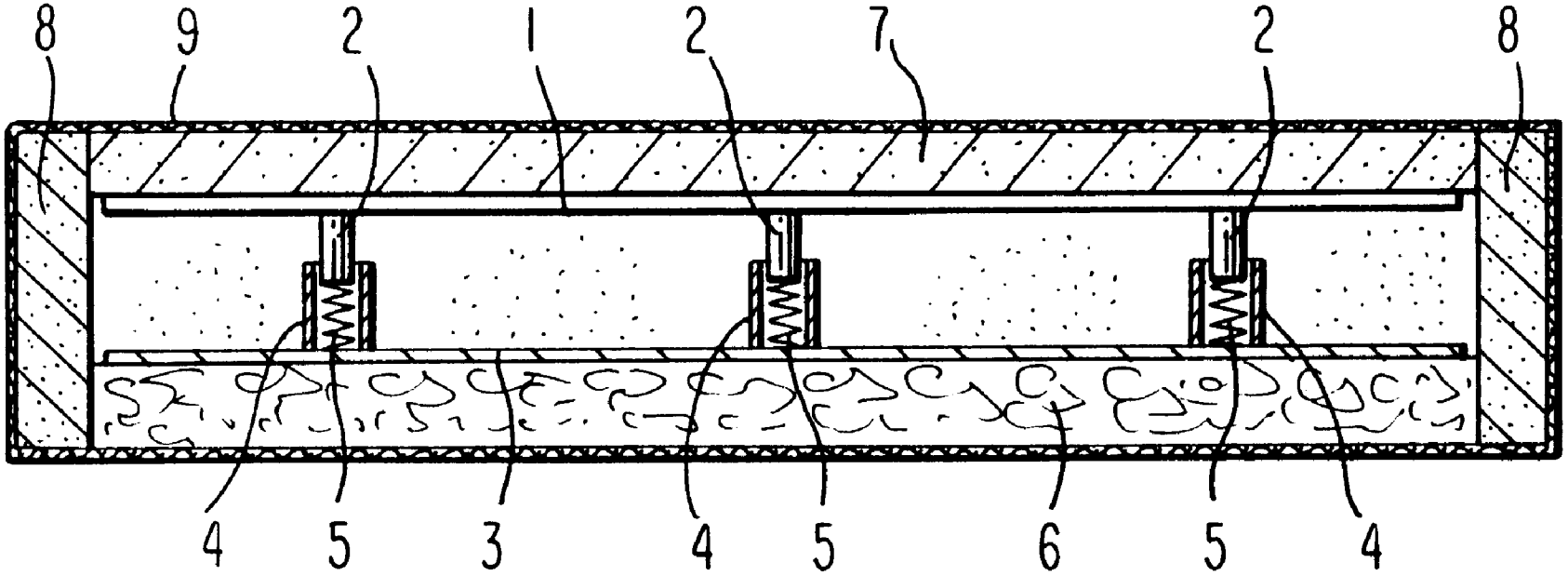
FIG. 3 is a view showing a transverse section of the anatomic mattress in accordance with the present invention taken along the line 3—3.

An anatomic mattress in accordance with the present invention has an internal structure including an upper part and a lower part. The upper part is composed of a plurality of plates 1 formed as crevices. The plates 1 can be composed of plastic material with a necessary resistance. 5 Each of the plates 1 has a lower surface provided with a plurality of projections 2 formed as tongues. The number of the projections can be varied. However, preferably there are 3÷30 projections on each of the plates 1. As can be seen from the drawings, the plates 1 are located adjacent to one another and can be connected with one another by a separate band, or by an upholstering or padding of the mattress itself.

The internal structure of the mattress further has a lower part which is formed as an integral plate 3 having a size substantially corresponding to the size of the mattress. The plate 3 can also be composed of plastic material having a sufficient resistance. The plate 3 has an upper surface provided with a plurality of grooves 4. The grooves 4 are formed so that the projections 2 of the upper plates 1 can be inserted in the grooves. In the shown embodiment, the grooves 4 are formed as sockets projecting upwardly from the upper surface of the plate 3. The projections 2 are inserted in the sockets 4 with interposition of damping elements, formed for example by highly flexible steel springs 5.

The anatomic mattress of the invention further has an external structure which includes a layer 6 located under the plate 3 and composed of cotton, foam, sisal or similar material. A further layer 7 which can be composed of natural latex foam, of polyurethane foam, or of another material is arranged over the plates 1 or in other words, on the upper surface of the upper part of the internal structure. Also, a layer 8 composed of a latex foam, a polyurethane foam, and the like extends at the sides of the upper part 1 and the lower part 3 over the whole contour of the mattress. Finally, the whole above mentioned structure can be covered by an appropriate fabric (clothes, textile, etc.) 9 of any type.

When the anatomic mattress is designed in accordance with the present invention, it is highly superior to the existing mattresses, and combines the advantages of the springs and of the foam, which are the materials flexible in proportion to the weight of the body. The internal structure supports the more heavy parts but does not deform itself because of its articulation through the system of the projections, grooves, and springs. Therefore the user obtains a perfect resting position with his/her musculature accommodated on a soft and comfortable surface and having at the same time his/her spine perfectably equilibrated.

It will be understood that each of the elements described above, or two or more together, may also find a useful application in other types of constructions differing from the types described above.

While the invention has been illustrated and described as embodied in anatomic mattress, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An anatomic mattress, comprising an external structure; and an internal structure located interiorly of said external structure, said internal structure including an upper part and a lower part, said lower part being formed as a continuous lower plate, while said upper part being formed by a plurality of individual upper plates connected with said lower plate; and means for connecting said upper plate with said lower plate, said connecting means including a plurality of projections located on one of said upper plates and said lower plate and a plurality of grooves located on the other of said upper plate and said lower plates so that said projections are inserted in said grooves, said connecting means further including a plurality of springs each located in a respective one of said grooves between one of said grooves and one of said projections.

2. An anatomic mattress as defined in claim 1, wherein each of said upper plates has a lower surface provided with a plurality of said projections, said lower plate having an upper surface provided with a plurality of said grooves in which projections engage.

3. An anatomic mattress as defined in claim 1, wherein said upper part has an upper surface, said external structure having an upper layer arranged on said upper surface of said upper part.

4. An anatomic mattress as defined in claim 3, wherein said upper layer is composed of a material performing padding functions.

5. An anatomic mattress as defined in claim 3, wherein said upper layer is composed of a material performing upholstering functions.

6. An anatomic mattress as defined in claim 1, wherein said lower part has a lower surface, said exterior structure having a lower layer provided on said lower surface of said lower part.

7. An anatomic mattress as defined in claim 6, wherein said lower layer of said external structure is formed as a foam layer.

8. An anatomic mattress as defined in claim 1, wherein said internal structure has sides, said external structure having a side layer extending outwardly and along said sides of said internal structure.

9. An anatomic mattress as defined in claim 1, wherein said internal structure has an upper surface, a lower surface, and side surfaces, said external part having an upper layer arranged on said upper surface, a lower layer arranged on said lower surface, and a side layer arranged around said side surfaces of said internal structure; and further comprising a fabric covering said upper, lower, and side layers.

10. An anatomic mattress, comprising an external structure; and an internal structure located interiorly of said external structure, said internal structure including an upper part and a lower part, said lower part being formed as a continuous lower plate, while said upper part being formed by a plurality of individual upper plates connected with said lower plate; and means for connecting said upper plate with said lower plate, said connecting means including a plurality of projections located on one of said upper plates and said lower plate and a plurality of grooves located on the other of said upper plates and said lower plate so that said projections are inserted in said grooves, said connecting means further including a plurality of springs each located in a respective one of said grooves between one of said grooves and one of said projections, each of said springs being formed as a cylindrical spring, each of said grooves being formed as a socket, so that each of said projections is inserted in a respective one of said sockets, and only one of said cylindrical springs is inserted in one of said sockets between said socket and one of said projections, each of said individual upper plates being formed as an elongated plate provided with a plurality of said projections distributed over a length of each of said elongated plates, each of said projections of said upper plates having an end face which presses a respective one of said springs toward said lower plate.

* * * * *